United States Patent [19]

Kaiser

[11] 4,124,921

[45] Nov. 14, 1978

[54] APPARATUS FOR CONSOLIDATING TEXTILE FIBROUS WEBS BY RUBBING IN A CONDENSER

[75] Inventor: Hans Kaiser, Waldshut, Fed. Rep. of Germany

[73] Assignee: Hanseatischer Maschinenbau GmbH, Hamburg, Fed. Rep. of Germany

[21] Appl. No.: 790,268

[22] Filed: Apr. 25, 1977

[51] Int. Cl.[2] ..... D01H 5/20

[52] U.S. Cl. ..... 19/153

[58] Field of Search ..... 19/151, 153, 105, 150, 19/244, 248, 249, 255

[56] References Cited

U.S. PATENT DOCUMENTS

| | | | |
|---|---|---|---|
| Re. 15,778 | 2/1924 | Kovar et al. | 19/153 |
| 1,709,881 | 4/1929 | Schimek | 19/153 |
| 2,690,628 | 10/1954 | Courtney et al. | 19/244 X |
| 2,896,269 | 7/1959 | Gardella et al. | 19/244 X |

FOREIGN PATENT DOCUMENTS

| | | | |
|---|---|---|---|
| 57,336 | 9/1912 | Austria | 19/105 |
| 432,978 | 10/1911 | France | 19/153 |
| 700,446 | 1/1966 | Italy | 19/153 |
| 22,912 of | 1901 | United Kingdom | 19/153 |
| 163,366 | 5/1921 | United Kingdom | 19/151 |

*Primary Examiner*—Dorsey Newton
*Attorney, Agent, or Firm*—Edward F. Levy

[57] ABSTRACT

In an apparatus for consolidating textile fibrous webs by rubbing in a condenser, the fibres are first conveyed through a first condenser in a first direction, further conveyed through a second condenser in a direction parallel to the first direction but opposite to it and finally they are conveyed through a third condenser in the first direction and in a plane parallel to it.

3 Claims, 4 Drawing Figures

APPARATUS FOR CONSOLIDATING TEXTILE FIBROUS WEBS BY RUBBING IN A CONDENSER

The present invention relates to a method of consolidating textile fibrous webs by rubbing in a condenser and to apparatus comprising a rubbing gear for performing the method.

In spinning machines, it is generally known to arrange a carding engine to be followed by a condenser which as a rule comprises a pair of endless, continuously circulating, rubbing belts co-operating by reciprocatory motions in opposite sense. In that case, the rubbing belts can also be so arranged that the web strips run through them in a perpendicular or nearly perpendicular path. Furthermore, a machine for the processing of textile fibres has already become known from the BE-PS 507 770, in which two pairs of rubbing gears each consisting of a lower and upper belt running in synchronism, are arranged behind one another in a horizontal transport plane, the upper and lower belts each being movable in opposite sense transversely to the conveying direction.

When the consolidation of rovings of pure wool, which is attainable with conventional rubbing gears, does not suffice for a spinning with very high drafting speeds, then, in the case of some types of man-made fibres with particularly smooth surface and little crinkling, one has to reckon with thread-splitting phenomena to a greater extent during the run down of rubbing gear spools, which in some circumstances puts a processing by way of the rubbing gear in question. If one now arranges two rubbing gears behind one another in a horizontal plane according to the BE-PS 507 770, then there results a rubbing gear with an appreciably greater length and increased space requirement, which however nevertheless is not in a position to impart a consolidation to the rovings, which is attainable by fliers.

Although, through an arrangement of the rubbing belts with vertical direction of passage according to the DT-PS 958 452, a shorter overall length can be attained with the use of only one pair of rubbing belts the too small overall height however stands in the way of an accommodation of several pairs of rubbing belts above one another.

It is therefore desirable to impart a consolidation to textile fibrous webs after their drafting and homogenization by rubbing in a condenser, which corresponds to that attainable by fliers, without increasing the space requirement or giving up the advantage of ease of manipulation.

According to one aspect of the present invention, there is now provided a method of consolidating textile fibrous webs by rubbing in a condenser, the method comprising the steps of consolidating such a web in a first stage while conveying it through a condenser in a first direction, further consolidating the web in a second stage while conveying it through the condenser in a second direction opposite to the first direction and yet further consolidating the web in a third stage while conveying it through the condenser in the first direction.

According to another aspect of the present invention, there is provided an apparatus for consolidating textile fibrous webs by rubbing in a condenser, the apparatus comprising a rubbing gear provided with at least four endless belts and drive means to impart to each of the belts a circulatory motion in a respective sense in a longitudinal direction of the belt and a reciprocatory motion in the direction perpendicular to the longitudinal direction, the arrangement being such that in use one run of the first belt co-operates with one run of the second belt through the first stage, another run of the second belt co-operates with one run of the third belt for the second stage and another run of the third belt co-operates with one run of the fourth belt for the third stage, the runs of each co-operating pair of runs extending parallel and closely adjacent to each other, moving at substantially the same speed and in the same direction in the circulatory motion and in respectively opposite sense in the reciprocatory motion. dr The invention will now be more particularly described by way of example with reference to the accompanying drawings, in which:

Figure 1:
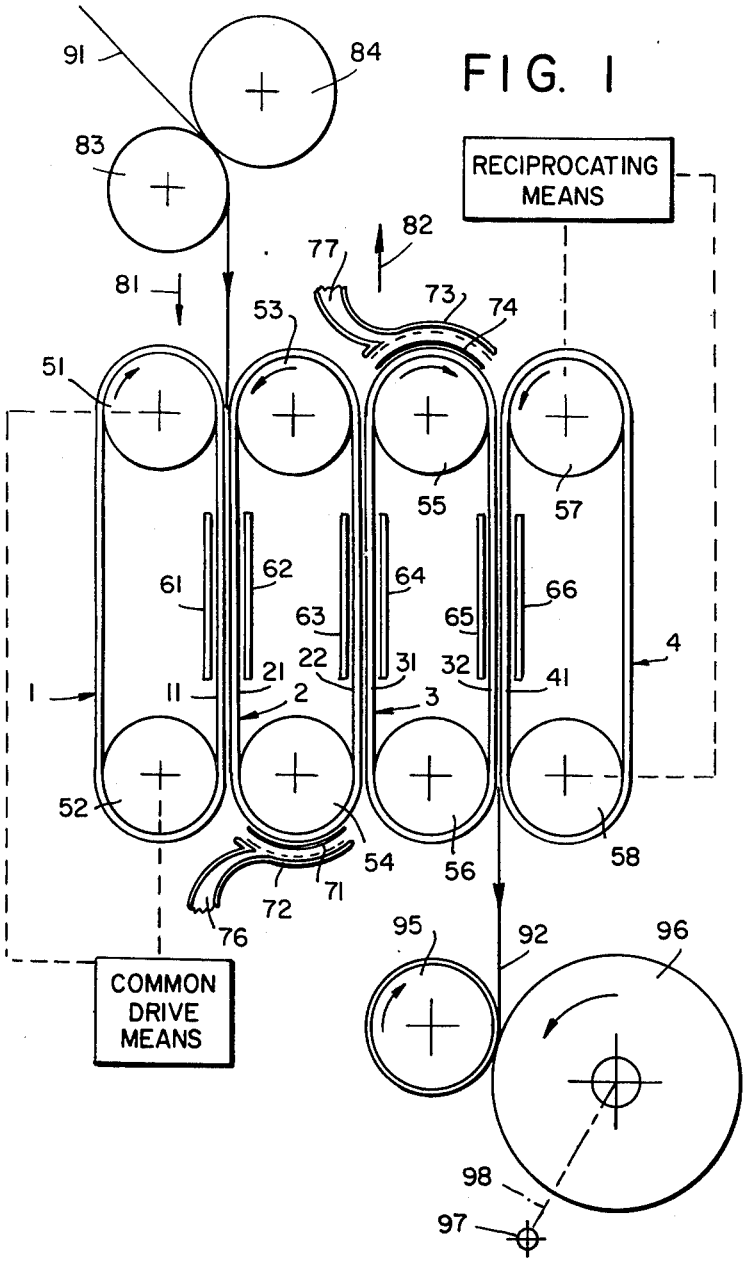
FIG. 1 shows a schematic side view of a condenser or rubbing gear embodying the present invention.
Figure 3:
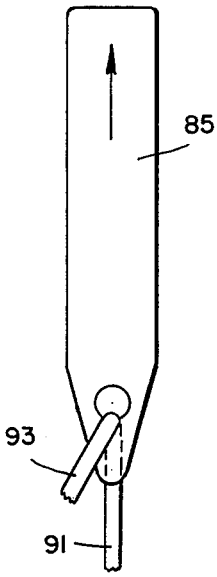
FIG. 3 shows to a still more enlarged scale a threading tag to assist in the introduction of a fibrous web into the apparatus shown in FIGS. 1 and 2.
Figure 4:
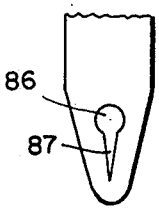
FIG. 4 shows a detail of the threading tag.
Figure 2:
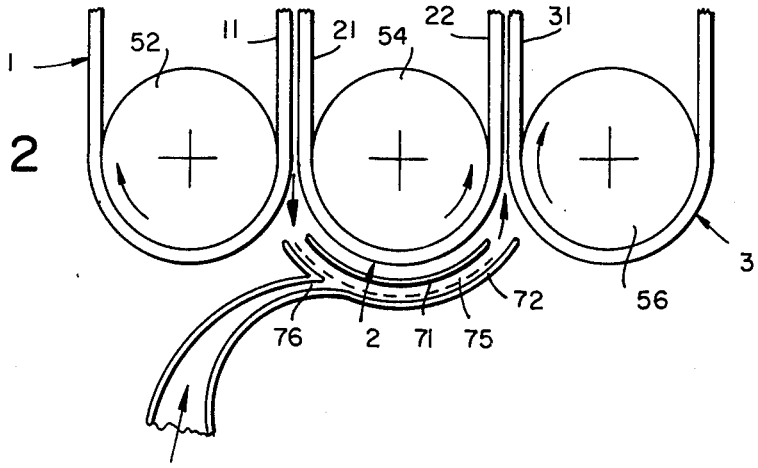
FIG. 2 shows to an enlarged scale a portion of the apparatus shown in FIG. 1.

Referring now to the drawing, supply rollers 83 and 84 are journalled in a frame (not shown) of a high performance spinning plant and are driven in any suitable known manner. These supply rollers 83 and 84 convey a fibrous web 91 downwardly in a vertical plane. A condenser rubbing gear is arranged underneath and downstream of the supply rollers 83 and 84, mounted to the frame of the high performance spinning plant and driven in any suitable known manner. The rubbing gear possesses four endless rubbing belts 1, 2, 3 and 4, each of which is carried, kept tensioned, and driven by a pair of rollers arranged perpendicularly above each other. The rubbing belt 1 is looped around the rollers 51 and 52, both of which rotate in clockwise sense. The rubbing belt 2 is disposed alongside the rubbing belt 1 and loops around the rollers 53 and 54, which both rotate in counterclockwise sense. The rubbing belt 3 is disposed to the right of the rubbing belt 2 and loops around the rollers 55 and 56, which both again rotate in clockwise sense. The rubbing belt 4 disposed to the right of the rubbing belt 3 is carried by rollers 57 and 58, which rotate in counterclockwise sense. The rubbing belts 1 to 4 are in that case so arranged that adjacent runs of different belts bear against one another and circulate at the same speed and in the same conveying direction while being supported in the free portions of their runs between the rollers by supports 61 to 66. The forward run 11 of the rubbing belt 1 is supported by a backing 61 and runs downwardly together with the forward run 21 of the rubbing belt 2 supported by the backing 62. The return run 22 of the rubbing belt 2, supported by the backing 63, runs synchronously with the forward run 31 of the third rubbing belt 3, supported by the backing 64, upwardly in a vertical plane with a conveying direction indicated by the arrow 82, that is to say parallel and opposite to the conveying direction indicated by the arrow 81 between the adjacent runs of the first and second rubbing belts 1 and 2. The return run 32 of the rubbing belt 3 supported by the backing 65 runs together with the forward run 41 of the fourth rubbing belt 4 supported by the backing 66 downwardly in a vertical plane in the conveying direction 81. The backing supports 61 to 66 can be constructed as rigid sheet metal plates or be arranged to be resiliently deflectable;

alternatively, the backing supports can be provided in the form of support rollers with resilient covers or resilient mounting or both. The rubbing belt 2 is provided in the region of the roller 54 with a rubbing belt cover 71, which covers the exposed arc of its circumference. A web deflecting member 72 is arranged substantially concentrically with the cover 71 while leaving open a slot 75. In the same manner, the exposed circumferential arc of the rubbing belt 3 in the region of the roller 55 is covered by a rubbing belt cover 74, which in turn is associated with a web deflecting member 73. The rollers 51, 52, 55 and 56 are synchronously displaceable in one axial direction and the rollers 53, 54, 57 and 58 are synchronously displaceable in the respectively opposite axial direction, both sets of rollers being connected with drive means (not shown) for the generation of the reciprocatory motion of opposite sense of the respectively adjacent runs of the rubbing belts 1 to 4.

In the operation, the leading end of the fibrous web 91 leaving the nip between the supply rollers 83 and 84 passes through a first stage of consolidation in downward direction 81 in a first conveying plane; this stage is formed by the forward run 11 of the rubbing belt 1 and the forward run 21 of the rubbing belt 2 circulating with the same speed. In consequence of the displacement of the rubbing belts 1 and 2 taking place at right angles to their conveying direction with the same stroke length but in respectively opposite sense, the fibrous web is rounded and experiences a first consolidation. On passing the rollers 52 and 54, the fibre web 91, when conveyed at adequate speed, comes to bear against the inside of the web deflecting member 72 and is guided by this around the lower half of the roller 54. Due to the rubbing belt cover 71 covering the outside of the rubbing belt 2, the transverse motions of the rubbing belt 2 can have no influence on the consolidated fibrous web 91. After passing around the lower circumferential arc of the roller 54, the fibrous web 91 runs into the second stage formed by the return run 22 of the rubbing belt 2 and the forward run 31 of the rubbing belt 3 and is conveyed upwardly in direction 82, that is to say opposite to direction 81, and is then further consolidated by renewed rounding. After is deflection by means of the web deflecting member 73 after passing the rollers 53 and 55, the web runs in the first conveying direction 81 through the third consolidation stage, which is formed by the return run 32 of the rubbing belt 3 and the forward run of the rubbing belt 4.

The aforedescribed manner of the guidance and treatment of the fibrous web permits not only a conveying of sensitive or even voluminous fibrous webs 91 at very high conveying speed, but is also capable of delivering at several times greater conveying speed rovings of a quality and uniformity comparable with those obtainable with a flier.

The time required for the introduction of a new fibrous web may be of great significance for the attainable performance. For this purpose, for example, a blower nozzle 76 can be arranged to open out tangentially into the web deflecting member 72 and a blower nozzle 77 to open out tangentially at the web deflecting member 73. The air blown in through the blower nozzles 76 and 77 conveys the fibrous web, at least during the introduction thereof, through the slot 75 disposed between the rubbing belt cover 71 and the deflecting member 72 and between the rubbing belt cover 74 and the web deflecting member 73. Alternatively or additionally, a threading tag 85 may however be employed. After hooking the end 93 of a fibrous web into the catching notch 87 extending from a hole 86 in the threading tag 85 of a flexible material, the fibrous web 91 lets itself be conveyed at full operating speed through the three consolidation stages of the condenser rubbing gear.

The compact arrangement of the rubbing gear with the outlet of the rovings 92 downwards makes possible the arrangement of a spooling device directly underneath the two rubbing belts 3 and 4. Such a spooling device can for example consist of a rocker 98, pivotable about an axle 97 fast with the frame and spring-loaded in counterclockwise sense, for the reception of a cross coil 96 and a cross coil driving roller 95, journalled fast to the frame and driven in conterclockwise sense.

While a preferred embodiment of the invention has been shown and described herein, it is obvious that numerous omissions, changes and additions may be made in such embodiment without departing from the spirit and scope of the invention.

What is claimed is:

1. Apparatus for consolidating fibrous webs, comprising a rubbing gear assembly provided with at least four endless belts and drive means for imparting to each of the belts a circulatory motion in longitudinal direction and a reciprocatory motion in direction normal to the longitudinal direction, so that in use one run of the first belt cooperates with one run of the second belt for the first stage, another run of the second belt cooperates with one run of the third belt for the second stage and another run of the third belt cooperates with one run of the fourth belt for the third stage, the runs of each cooperating pair of runs extending parallel and closely adjacent to each other and moving at substantially the same speed in the same longitudinal direction but in respectively opposite sence in the reciprocatory direction;

said belts being arranged and adapted to convey a fibrous web therebetween in a continuous path successively through said first, second and third stages, while consolidating said web by rubbing in each of said stages, with said web travelling in a first direction in said first and third stages and in a second, opposite direction in said second stage;

belt rollers about which the respective belts are trained;

cover members loosely mounted adjacent to the respective second and third belts between one and the other run thereof in the region of the respective rollers;

web deflecting members extending radially outwardly of each cover member to form a channel therewith for guiding the fibrous web at both sides between the first and second stages and between the second and third stages, respectively; and orifice means in at least one of said channels for introducing a stream of air into said at least one channel in a direction substantially tangential to the respectively adjacent belt roller.

2. Apparatus as defined in claim 1, wherein said orifice means comprises a slot-shaped nozzle.

3. Apparatus for consolidating fibrous webs, comprising a rubbing gear assembly provided with at least four endless belts and drive means for imparting to each of the belts a circulatory motion in longitudinal direction and a reciprocatory motion in direction normal to the longitudinal direction, so that in use one run of the first belt cooperates with one run of the second belt for the first stage, another run of the second belt cooperates with one run of the third belt for the second stage and another run of the third belt cooperates with one run of the fourth belt for the third stage, the runs of each cooperating pair of runs extending parallel and closely adjacent to each other and moving at substantially the same speed in the same longitudinal direction but in respectively opposite sense in the reciprocatory direction;

said belts being arranged and adapted to convey a fibrous web therebetween in a continuous path successively through said first, second and third stages, while consolidating said web by rubbing in each of said stages, with said web travelling in a first direction in said first and third stages and in a second, opposite direction in said second stage;

belt rollers about which the respective belts are trained;

a first arcuate cover member loosely mounted adjacent to the portion of the second belt trained around the respective roller between said first and second stages, and a second arcuate cover member loosely mounted adjacent to the portion of the third belt trained around the respective roller between said second and third stages;

an arcuate web deflecting member spaced outwardly of each of said cover members and forming therebetween a channel, said channels guiding the fibrous web at both sides between the first and second stages and between the second and third stages respectively;

the arcuate cover members of each of said channels being sized to cover over the exposed belt portion trained around the adjacent roller and to shield said web from the rubbing action of said belt portion.

* * * * *